United States Patent [19]

Miller

[11] 4,127,995

[45] Dec. 5, 1978

[54] MULTIPLE BOLT COMBINATION LOCK

[75] Inventor: Norman Miller, Lafayette, Ind.

[73] Assignee: Schwab Safe Co., Inc., Lafayette, Ind.

[21] Appl. No.: 787,934

[22] Filed: Apr. 15, 1977

[51] Int. Cl.[2] ..... E05B 37/08; E05B 63/14

[52] U.S. Cl. ..... 70/119; 70/303 R

[58] Field of Search ..... 70/115, 119, 122, 126, 70/133, 138, 301, 302, 303 R, 303 A, 322, 326

[56] References Cited

U.S. PATENT DOCUMENTS

| | | | |
|---|---|---|---|
| 183,192 | 10/1876 | Millward | 70/119 |
| 1,617,038 | 2/1927 | Watson | 70/322 |
| 1,744,707 | 1/1930 | Iznaga | 70/303 R |
| 2,445,511 | 7/1948 | Claveria | 70/119 |
| 2,816,432 | 12/1957 | Beauregard | 70/322 X |
| 2,836,049 | 5/1958 | Papini | 70/303 R X |
| 3,045,467 | 7/1962 | Herlong | 70/303 A |
| 3,158,017 | 11/1964 | Guze | 70/119 |

*Primary Examiner*—Thomas J. Holko

*Attorney, Agent, or Firm*—Cushman, Darby & Cushman

[57] ABSTRACT

A multiple bolt combination lock with a combination dial having a shaft rotatable with the dial and extending through a wheel post and a bottom pan to engage locking wheels having gates which can be aligned by manipulation of the wheel. The bottom pan is fixed to a top pan having a plurality of locking rods pivotably attached thereto at a distance from the center of rotation so that rotation of the pans in one direction causes the rods to retract and rotation in the opposite direction causes the rods to advance. When the gates are aligned, a lever arm mounted on the bottom pan pivots under the urging of a spring into a position latching the dial and pans together for rotation. When the dial is rotated in a direction so as to advance the rods into a latching position, a cam on the wheel post which extends through a slot in the bottom pan engages the lever arm to pivot that arm out of the gates after the rods are in the latching position.

3 Claims, 2 Drawing Figures

MULTIPLE BOLT COMBINATION LOCK

BRIEF DESCRIPTION OF THE BACKGROUND OF THE INVENTION AND SUMMARY OF THE INVENTION

The invention relates to an improved multiple bolt combination lock.

Combination locks have been in wide use for many years. Basically, such locks include an accessible dial which can be manually rotated and which includes a shaft which rotates with the dial. A cam wheel is mounted for rotation with the shaft and engages a plurality of locking wheels, each of which has a slot defining a gate and each of which is freely rotatable about the dial shaft. When the gates of the wheels are aligned by manual rotation of the dial in opposite directions to prescribed positions, which positions define the combination, a latch or some other mechanism shifts its position to permit the bolts to be withdrawn from their latching positions.

The bolts are conventionally withdrawn by operation of a separate mechanism, usually a handle which rotates to move the bolts.

The present invention relates to an improved and simplified combination lock in which no separate mechanism for retracting the locking bolts is required. Rather, when the lock has been manually manipulated to a position with the cam and locking wheels properly aligned, a lever arm drops into the gates under the urging of a spring and couples for rotation with the dial the top and bottom pans of the lock between which the wheel post and wheels are mounted. On the outer surface of the top pan, the lock bolts are pivotably fixed at a location separated from the center of rotation thereof. Thus, continued rotation of the manual dial after the correct combination has been reached and the cam and wheels properly aligned, operates to retract the bolts. Rotation of the dial subsequently in the opposite direction returns the bolts to the latching position. A cam member on the wheel post which preferably extends through a slot in the bottom pan engages the lever arm to cam the lever arm out of the slots when the bolts have been returned to the locking position so that the above steps may be repeated to retract the bolts and open the lock.

Other objects and purposes of the invention will be clear from the following detailed description of the drawings.

DETAILED DESCRIPTION OF THE DRAWINGS

Figures 1, 3:
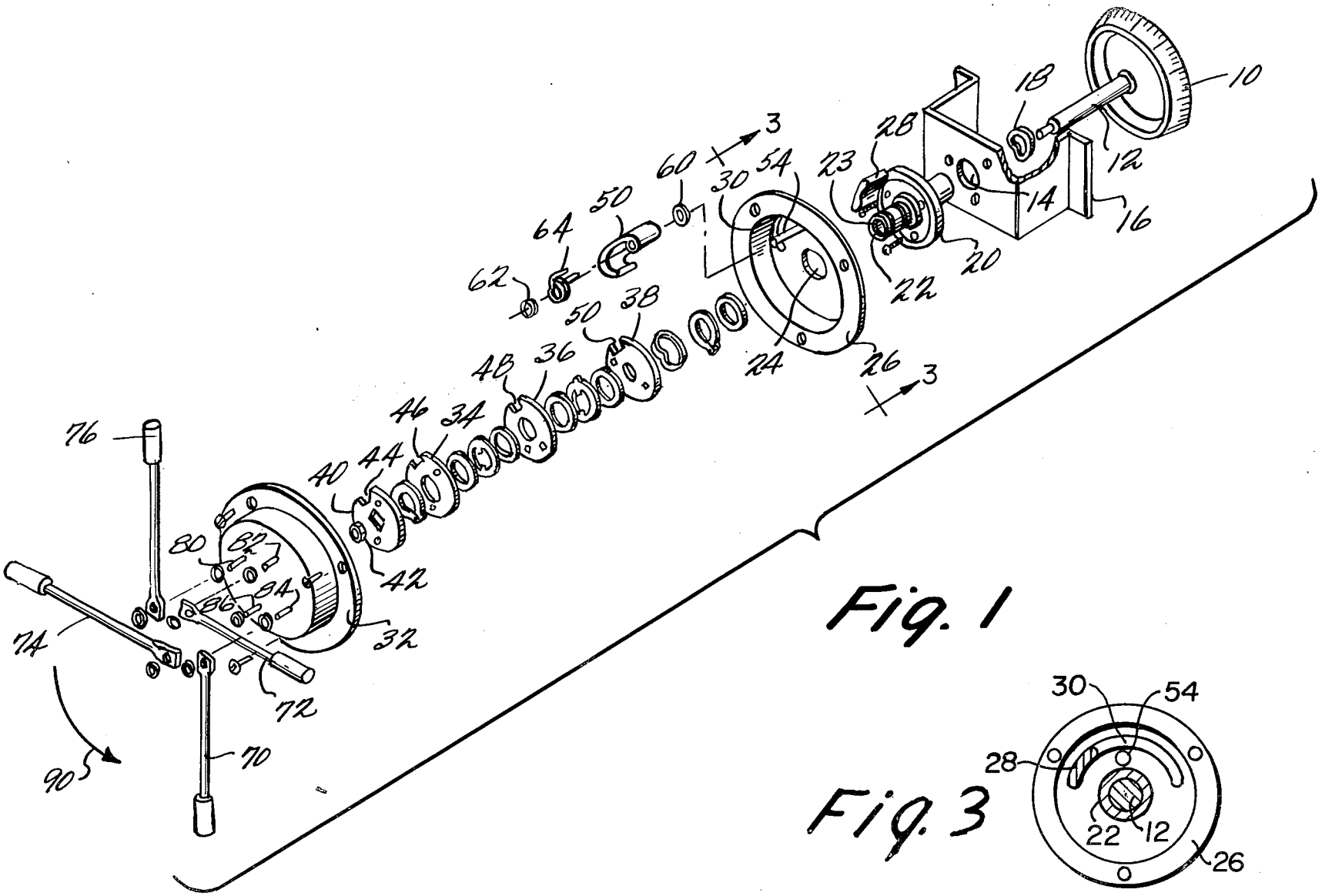
FIG. 1 shows an exploded view of the unique combination bolt of the present invention in perspective.
FIG. 3 shows a sectional view along the lines 3–3 in FIG. 1.
Figure 2:
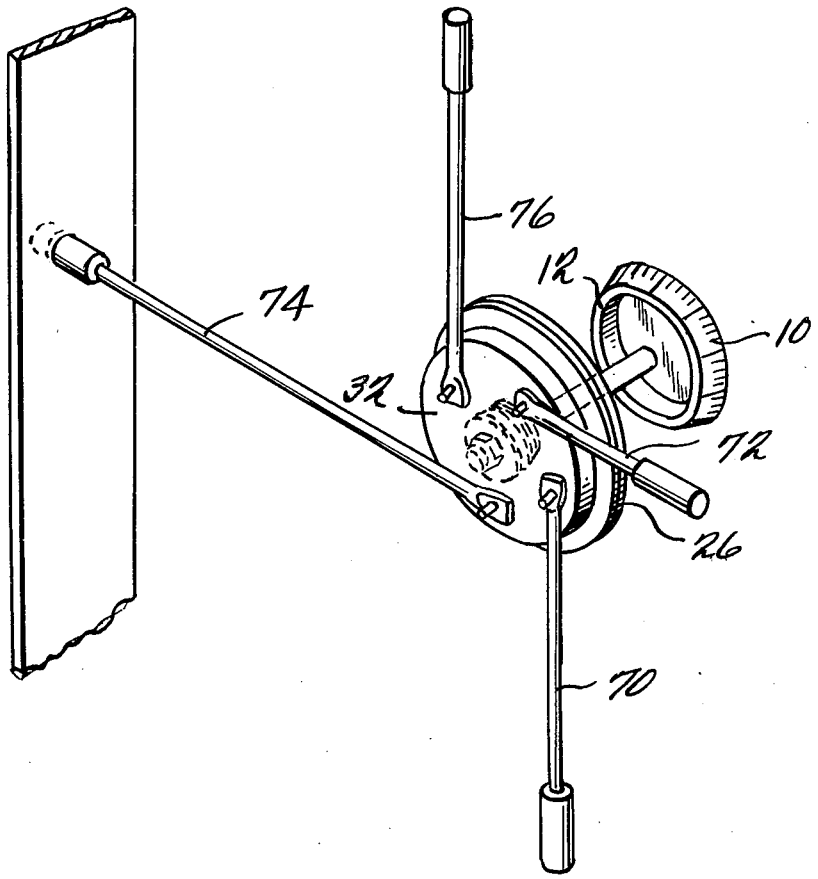
FIG. 2 shows an assembled perspective view of the lock of the present invention with the surrounding structure of the door or the like removed so that the lock components can be seen.

Reference is now made to FIGS. 1–3 which illustrate one embodiment of the present invention. The lock of the present invention includes a dial 10 having a number of indicia which may be numbers, letters, or lines which match with numbers or letters on a stationary surface adjacent the dial. Dial 10 includes a shaft 12 which extends through aperture 14 of lock stand 16 and through a tensioning washer 18. Stand 16 is fixed by any suitable means to the door or other structure to be protected. Shaft 12 further extends through a bore within wheel post 20, which is fixed to stand 16 by screws as shown in the exploded perspective view of FIG. 1 or by any other suitable means.

Post 20 includes a portion 22 which extends through a bore 24 in the bottom pan 26. A cam portion 28 of post 22 also extends through a slot 30 in bottom pan 26.

Bottom pan 26 is fastened to top pan 32 by suitable screws or the like and pans 26 and 32 define between them a closed interior space in which a plurality of conventional locking wheels 34, 36 and 38 together with the conventional nylon washers as shown, are arranged about the portion 22 of wheel post 20.

Shaft 12 extends through bore 23 of post 20 and mounts at the end thereof a conventional cam 40 by means of a nut 42. Cam 40 rotates freely with shaft 12 and dial 10 and conventionally engages locking wheels 34, 36 and 38, so that these wheels rotate selectively with cam 40 and can be moved by proper manipulation of dial 10 into a position with each of the respective gates 44, 46, 48 and 50 of cam 40 and locking wheels 34, 36 and 38, respectively, aligned. The gates are formed as slots.

A lever arm 50 is pivotably mounted about a pin 54 extending from bottom pan 26 into the interior space defined between pans 26 and 32, and is held in place by washers 60 and 62. A spring 64 urges lever arm 50 toward a position in which arm 50 drops into the aligned gates 44, 46, 48 and 50, to temporarily couple shaft 12 to pans 26 and 32 so that the pans rotate with the shaft.

On the surface of top pan 32 which is remote from bottom pan 26, four conventional locking bolts 70, 72, 74 and 76 are pivotably mounted about suitable pins 80, 82, 84 and 86. These locking bolts extend into structure which surrounds top plate 32 in a conventional way. When bottom plate 32 is connected to shaft 12 for rotation therewith by lever arm 50, the rotation of dial 10 in the direction indicated by arrow 90 retracts the respective bolts 70, 72, 74 and 76 so that the door or other structure which mounts the combination lock, can be opened.

When it is desired to close the lock, rotation of the dial 10 in a direction opposite to arrow 90 advances the retracted bolts to their latching positions. Further rotation of the dial causes lever arm 50 to move outward under the urging of the cam portion 28 of wheel post 20 moving in slot 30 until the lever releases the wheels which are then free to resume a non-aligned position, awaiting further manipulation of the lock to the correct position to reopen the same.

Many changes and modifications in the above described embodiment of the invention can, of course, be carried out without departing from the scope of the same. Accordingly, that scope is intended to be limited only by the scope of the appended claims.

What is claimed is:

1. A multiple bolt combination lock comprising:

a combination dial having a shaft rotatable therewith;

a plurality of locking wheels disposed about said shaft, each having a slot gate, the gate of each wheel aligning in a given position when the dial is rotated to the correct combination;

a bottom lock pan having an aperture through which said shaft extends;

a top lock pan fastened to said bottom lock pan to define a space therebetween in which said wheels are disposed;

a lever arm;

means for mounting said lever arm on said bottom lock pan in said space so that said lever arm pivots to engage said slot gates when said wheels are aligned at said given position and so that said lock pans then rotate with said shaft;

spring means for urging said lever arm into engagement with said slot gates;

a plurality of locking rods pivotably fastened to one of said lock pans at a distance from the center of rotation thereof so that rotation of said one lock pan in one direction retracts said rods and rotation of said one lock pan in the opposite direction advances the rods into a latch position;

a lock stand having an aperture through which said shafts extends; and a wheel post having a bore and fixed to said lock stand with said bore and aperture in alignment, said post including a cam portion extending through a slot in said top pan to engage said lever arm to rotate said lever arm out of said slot gates when said one pan is rotated in said opposite direction and said rods are in said latch position.

2. A lock as in claim 1, including four said rods.

3. A lock as in claim 1, wherein said one lock pan is the top pan.

* * * * *